US007828670B1

(12) United States Patent
Schroader

(10) Patent No.: US 7,828,670 B1
(45) Date of Patent: Nov. 9, 2010

(54) PUTTER GRIP BALL MARKER RETENTION SYSTEM

(76) Inventor: Jack Schroader, 6369 Cobblerock La., Holladay, UT (US) 84121

( * ) Notice: Subject to any disclaimer, the term of this patent is extended or adjusted under 35 U.S.C. 154(b) by 0 days.

(21) Appl. No.: 12/047,220

(22) Filed: Mar. 12, 2008

Related U.S. Application Data

(60) Provisional application No. 60/894,491, filed on Mar. 13, 2007.

(51) Int. Cl.
*A63B 53/14* (2006.01)

(52) U.S. Cl. ..... 473/285

(58) Field of Classification Search ..... 473/285–286
See application file for complete search history.

(56) References Cited

U.S. PATENT DOCUMENTS

| | | | | | |
|---|---|---|---|---|---|
| 1,756,141 | A | | 4/1930 | Spellmeyer | |
| 1,830,936 | A | | 11/1931 | Faith | |
| 2,261,959 | A | * | 11/1941 | Buttikofer | 473/285 |
| 2,700,547 | A | | 1/1955 | Kraeling, Jr. | |
| 2,979,335 | A | | 4/1961 | Pruitt | |
| 3,405,408 | A | | 10/1968 | Baker | |
| 3,847,110 | A | | 11/1974 | Inoue | |
| 3,851,357 | A | | 12/1974 | Ribich et al. | |
| 3,895,797 | A | | 7/1975 | Moore | |
| 4,168,067 | A | | 9/1979 | Wiczer | |
| 4,239,216 | A | * | 12/1980 | Bauer | 473/285 |
| 4,248,430 | A | | 2/1981 | Kepler | |
| 4,380,337 | A | | 4/1983 | DiMatteo | |
| 4,554,710 | A | | 11/1985 | Grant | |
| 4,822,052 | A | | 4/1989 | Dimmick et al. | |
| 4,835,821 | A | | 6/1989 | Durante | |
| 4,957,293 | A | | 9/1990 | Byrd | |
| 4,968,037 | A | * | 11/1990 | Berry | 473/285 |
| 5,026,062 | A | | 6/1991 | Freeberg | |
| 5,031,812 | A | | 7/1991 | Gustine | |
| 5,102,139 | A | | 4/1992 | Greig | |
| 5,143,371 | A | | 9/1992 | Strahan | |
| 5,282,616 | A | | 2/1994 | Stacavich-Notaro | |
| 5,351,949 | A | | 10/1994 | Fox et al. | |
| 5,690,558 | A | | 11/1997 | Huber | |
| 5,769,740 | A | * | 6/1998 | Colangelo | 473/408 |
| 5,795,249 | A | * | 8/1998 | Johnson | 473/406 |
| 2004/0248674 | A1 | * | 12/2004 | Bauley et al. | 473/406 |
| 2007/0219023 | A1 | * | 9/2007 | Stanley | 473/408 |

* cited by examiner

*Primary Examiner*—Stephen L. Blau
(74) *Attorney, Agent, or Firm*—Thorpe North & Western LLP

(57) ABSTRACT

A golf ball marker retention system, comprising: a retaining cavity associated with a golf club handle, the retaining cavity having an entry channel that expands as an object is inserted and contracts when the object has been substantially fully inserted within the cavity, the cavity being oriented substantially perpendicular to an elongate axis of the golf club handle; and a ball marker receivable within the cavity, the ball marker being insertable and storable within the retaining cavity and being sized and shaped such that, as the marker is inserted into the cavity through the entry channel, the entry channel first expands and then contracts after the marker has been substantially fully received within the retaining cavity.

20 Claims, 4 Drawing Sheets

PUTTER GRIP BALL MARKER RETENTION SYSTEM

Priority is claimed of U.S. Provisional Patent Application No. 60/894,491, filed Mar. 13, 2007, which is hereby incorporated herein by reference in its entirety.

BACKGROUND OF THE INVENTION

1. Field of the Invention

The present invention relates generally to accessories used in the sport of golf.

2. Related Art

When playing the sport of golf it is often required that, once a player's ball has landed on the green, the ball be removed by the player prior to his or her completing the hole in order to provide another player a free path to the cup (or simply to allow the player to clean the ball prior to putting). To ensure that the player returns the ball to the same spot it occupied on the green prior to being picked up, a so-called ball marker is placed on or in the green to mark the location of the ball. A variety of different types of ball markers have been developed for this use: with arguably the most popular type comprising a flat, disk-like marker that lies on the top surface of the green (and may include a downwardly extending spike to anchor the marker in the green). Such markers are relatively inexpensive to produce and are produced by the thousands each year.

While many players carry such markers, it is remarkable how often such markers cannot be easily located when a player wishes to mark his or her ball. Due to this difficulty, attempts have been made to provide storage locations for such markers to increase the likelihood that a player can locate a marker when he or she requires one. Such attempts include forming a "snap" retention device in golf gloves to allow a marker to be carried on the glove until needed. Other attempts include forming a cavity in a cap (e.g., hat), with the marker being held within the cavity until it is needed by the golfer.

Such attempts, while somewhat effective, require, of course that the golfer be wearing the glove or cap at the time the marker is needed. If the cap or glove was left in the golf cart, the golfer must retrieve it from the cart in order to use the marker. Such attempts have also resulted in many lost markers due to markers falling from the glove or the cap during regular play; thereby becoming unavailable for use when the golfer desires a marker.

SUMMARY OF THE INVENTION

It has been recognized that it would be advantageous to develop a ball marker retention system for reliably retaining a golf ball marker and providing easy access to the ball marker when it is desired by the player.

The invention provides a golf ball marker retention system, including: a retaining cavity associated with a golf club handle and having an entry channel that expands as an object is inserted and contracts when the object has been fully inserted, and wherein the cavity is perpendicular to the golf club handle; and a ball marker receivable within the cavity, the marker being insertable and storable within the retaining cavity, and configured such that when inserted into the cavity through the entry channel, the entry channel expands and then is allowed to contract after the marker has been fully received within the retaining cavity.

In accordance with another aspect of the invention, the system includes one or more retaining wings that at least partially define the cavity and that aid in or contribute to retaining the ball marker within the retaining cavity.

In accordance with another aspect of the invention, the system includes a slidable track; wherein the marker can be inserted into the cavity by sliding the marker through or within the slidable track.

In accordance with another aspect of the invention, the retaining wings are formed from a resilient material, and wherein:

the retaining wings are sufficiently rigid to retain the marker within the cavity, and are sufficiently flexible to facilitate removal of the ball marker from the cavity in a direction other than that provided by the slidable track.

In accordance with another aspect of the invention, the golf club comprises a putter, and the ball marker retention system is coupled to, attached to, or formed integrally with a grip portion of the putter.

In accordance with another aspect of the invention, an upper portion of the ball marker is at least partially covered by retaining structure of the system, such that the ball marker is restricted from moving in an upward direction out of the retention system.

In accordance with another aspect of the invention, the ball marker can be forcibly removed from the retaining cavity past or through the retaining structure of the system that at least partially covers the upper portion of the ball marker.

Additional features and advantages of the invention will be apparent from the detailed description which follows, taken in conjunction with the accompanying drawings, which together illustrate, by way of example, features of the invention.

DETAILED DESCRIPTION

Figure 1:
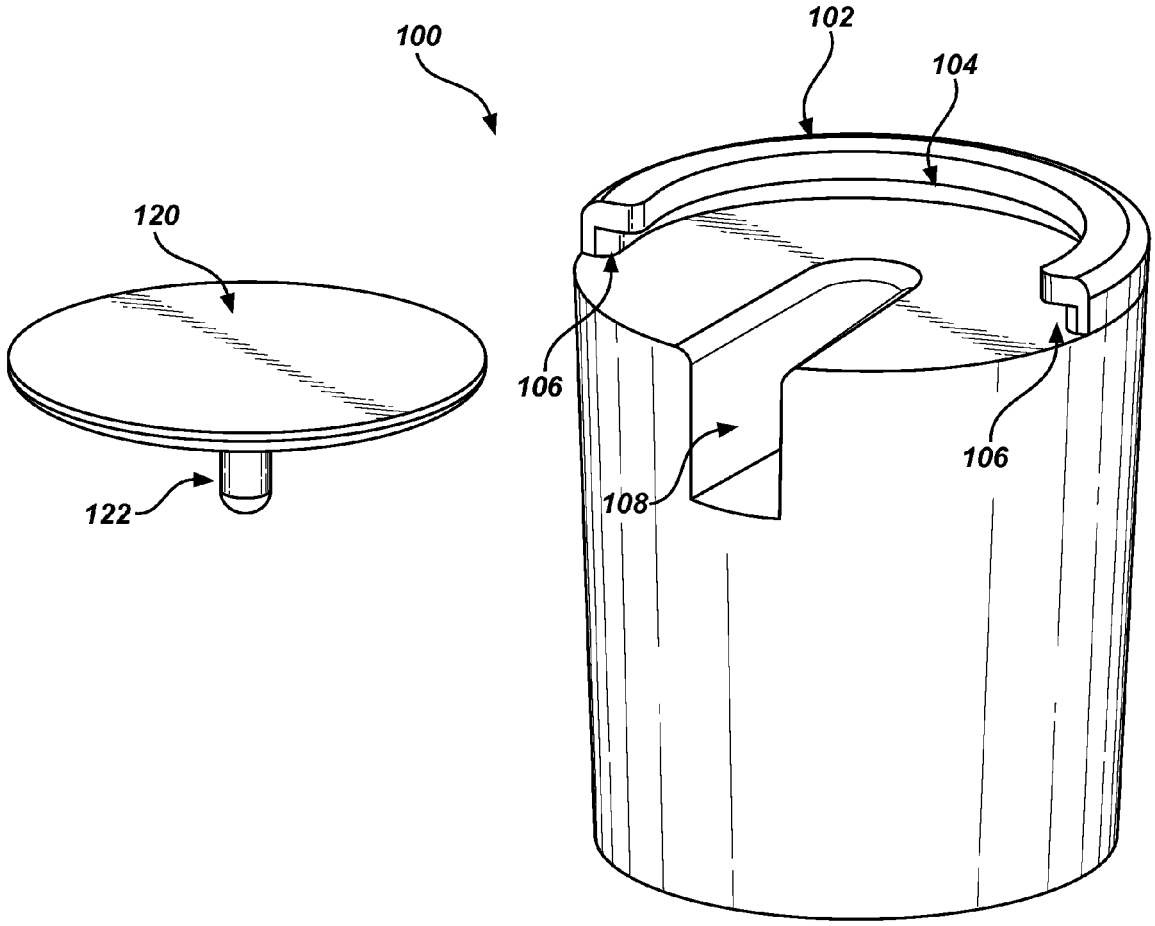
FIG. 1 is a perspective view of a ball marker retention system in accordance with an embodiment of the present invention, and a ball marker.
Figure 2:
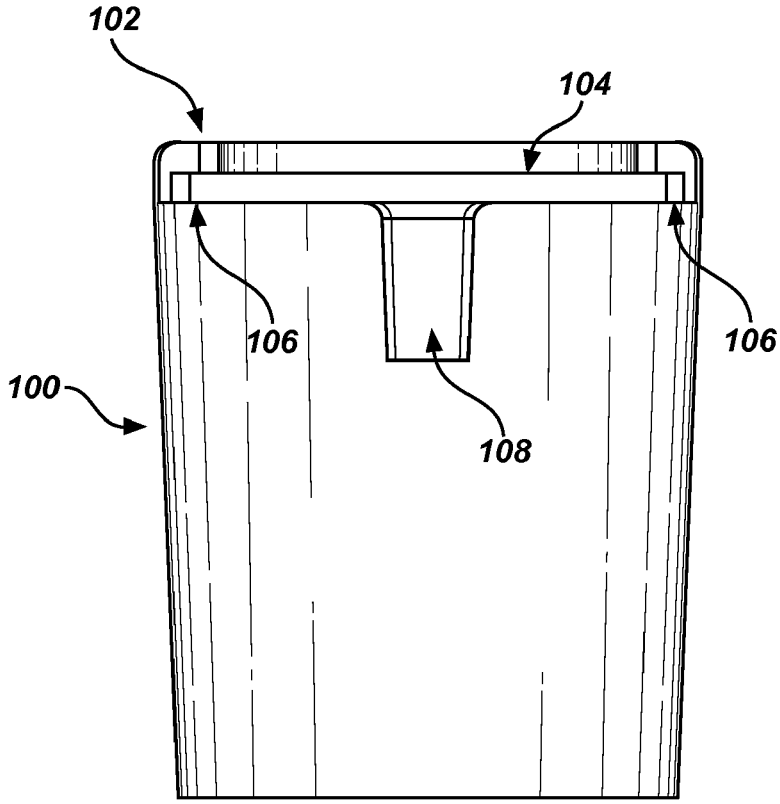
FIG. 2 is a front view of the ball marker retention system of FIG. 1.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As used herein, relative directional terms such as "upward," "downward," etc., are to be understood to be relative to the manner in which systems discussed herein are commonly understood to be oriented when in use. For example, with regard to a putter handle, "upwardly" refers to a direction relative to the situation in which the putter is positioned for use, with the grip handle oriented elevationally higher than the putter face of the club (the putter face being immediately adjacent to the upper surface of the putting green).

As used herein, reference to positional relation of a golf club handle relative to the system provided herein is to be understood as if the golf club handle had only a length dimension (extending from the grip to the portion of the club that comes in contact with a golf ball) and no width or depth dimension; such that in cases where the handle is said to be perpendicular to a portion of the system, said portion of the system is understood to extend in the X- and Y-axes while the golf club handle would extend in the Z-axis, much the same way as a pin is perpendicular to the head of the pin.

Figure 6:
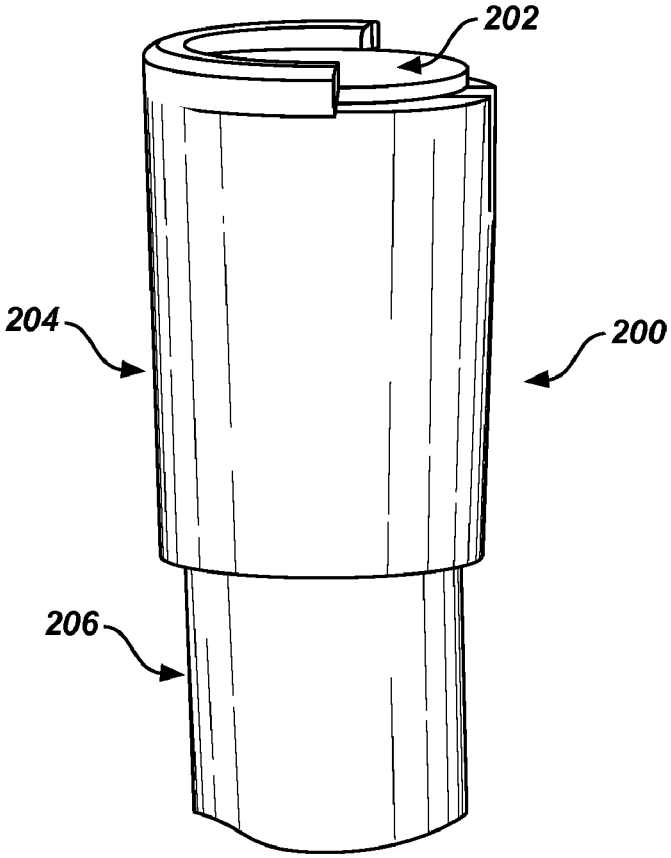
FIG. 6 is a ball marker retention system in accordance with an embodiment of the present invention, wherein the system is attached to the handle of a golf club.
Figure 7:
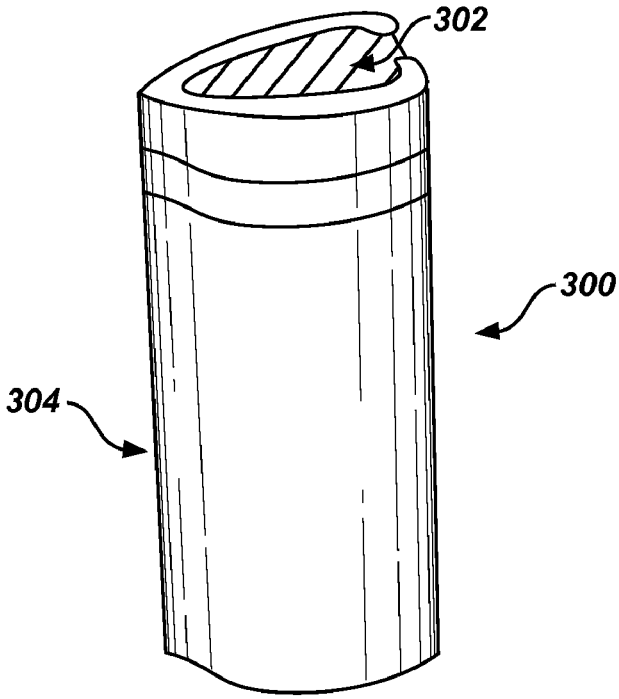
FIG. 7 is a ball marker retention system in accordance with an embodiment of the present invention, wherein the system is integrally formed with the handle of a golf club.

The present invention provides a golf ball marker retention system for use in storing a golf ball marker used by golfers in marking the location of a golf ball on a putting green. Referring to FIG. 1, the system 100 generally includes a retaining cavity 104 that can be formed on, or can be attached to, a golf club handle. A ball marker 120 can be receivable within the cavity 104, the ball marker 120 being insertable and storable within the retaining cavity 104. The ball marker 120 can be securely stored within the cavity 104 throughout a round of golf and, when needed, easily removed from the cavity 104 and used to mark the location of a ball on a green. When the player is finished with the marker 120, he or she can easily re-insert the ball marker within the cavity 104 for storage. As the system can be incorporated into (or attached to) the handle of a putter (see FIGS. 6-7), each time a player has cause to play on the green (e.g., each time the player and his or her group are putting), which is nearly always done using the putter, the player will have quick and easy access to the ball marker.

The present invention provides a golf ball marker retention system 100, comprising a retaining cavity 104 associated with a golf club handle and having an entry channel 106 that expands as an object (such as a golf ball marker 120) is inserted thereinto and contracts when the object has been fully inserted. The cavity 104 can be substantially perpendicular to an elongate axis of the golf club handle; and a ball marker 120 can be receivable within the cavity 104. The marker 120 can be insertable and storable within the retaining cavity 104, and configured such that when inserted into the cavity 104 through the entry channel 106, the entry channel 106 expands and then is allowed to contract after the marker 120 has been fully received within the retaining cavity 104.

The golf ball marker retention system 100 can further include a slidable track wherein the marker 120 can be inserted into the cavity 104 by sliding the marker through or within the slidable track. Associated with this slidable track, the system 100 can include at least one retaining wing 102 that at least partially defines the cavity 104 and that can aid in, or contribute to, retaining the ball marker 120 within the retaining cavity 104. The retaining wings 102 can be formed of a resilient material such that they are sufficiently rigid to retain the marker 120 within the cavity 104, and are sufficiently flexible to facilitate removal of the ball marker 120 from the cavity 104 in a direction other than that provided by the slidable track. In this embodiment, the marker 120 can be quickly and easily "popped" out of the cavity area 104 by the player when the marker 120 is needed. This can simplify the removal process by not requiring that the marker 120 be slid outward through or past the slide channel. Despite the fact that the retaining wings 102 are sufficiently pliable so as to be deflectable to allow removal of the marker 120, it has been found that the wings 102 are sufficiently rigid to retain the marker 120 within the cavity 104 through normal use of the putter: including removal from and insertion of the handle of the putter into a golf bag, use of the putter for putting, etc. The golf ball marker 120 can be formed from a variety of materials and can be formed in a variety of shapes and configurations. The marker 120 can be formed from metallic materials, polymers, wood, composite materials, etc. In embodiments illustrated in the figures, the marker 120 is formed in a generally ovoid shape, however, it is contemplated that round, square, rectangular shapes, etc., can also be realized. In one aspect of the invention, the golf ball marker retention system 100 can be formed such that an upper portion of the ball marker 120 is at least partially covered by the retaining structure 102 of the system 100, such that the ball marker 120 is restricted from moving in an upward direction out of the retention system 100. This feature can be understood to function in a couple of ways. First, the ball marker 120 can be forcibly removed from the retaining cavity 104 past or through the retaining structure 102 of the system that at least partially covers the upper portion of the ball marker. In other words, it can work in connection with the slidable track and wings 102, as discussed above, such that a golfer can remove the marker 120 by pulling vertically on the marker 120, thus causing the system 100 to flex and release the marker 120 in a vertical direction. Generally, without such force applied by the golfer, the marker 120 would be restricted from moving in an upward direction out of the retention system 100. Alternatively, this feature can be associated with the slidable track and can be independent of the retaining wings 102 such that the only way to remove the marker is to slide it out horizontally along the track (any vertical removal of the marker being impossible).

Figure 3:
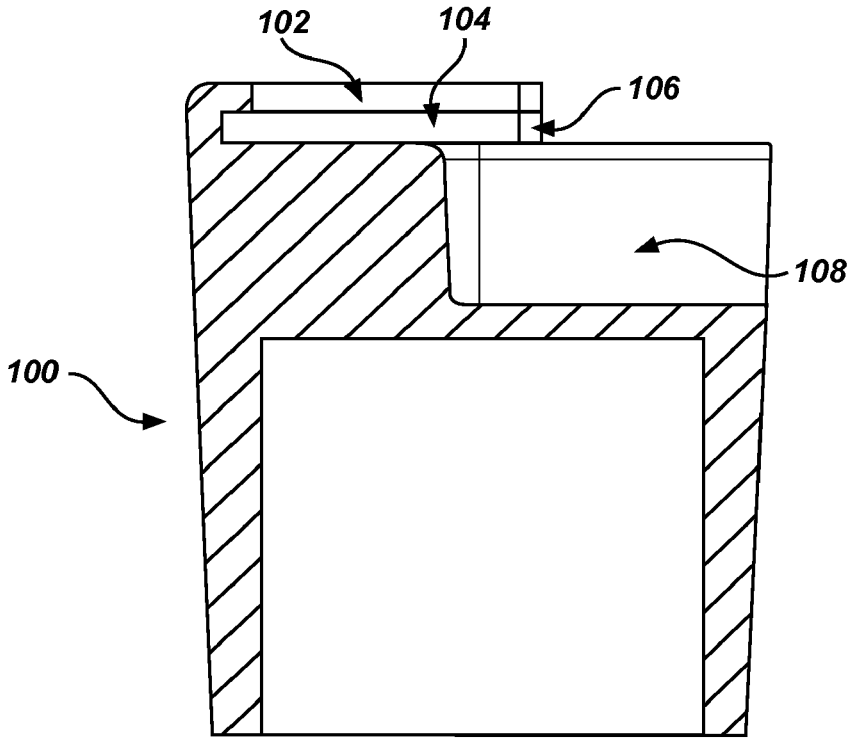
FIG. 3 is a cross-sectional left side view of the ball marker retention system of FIG. 1.
Figure 4:
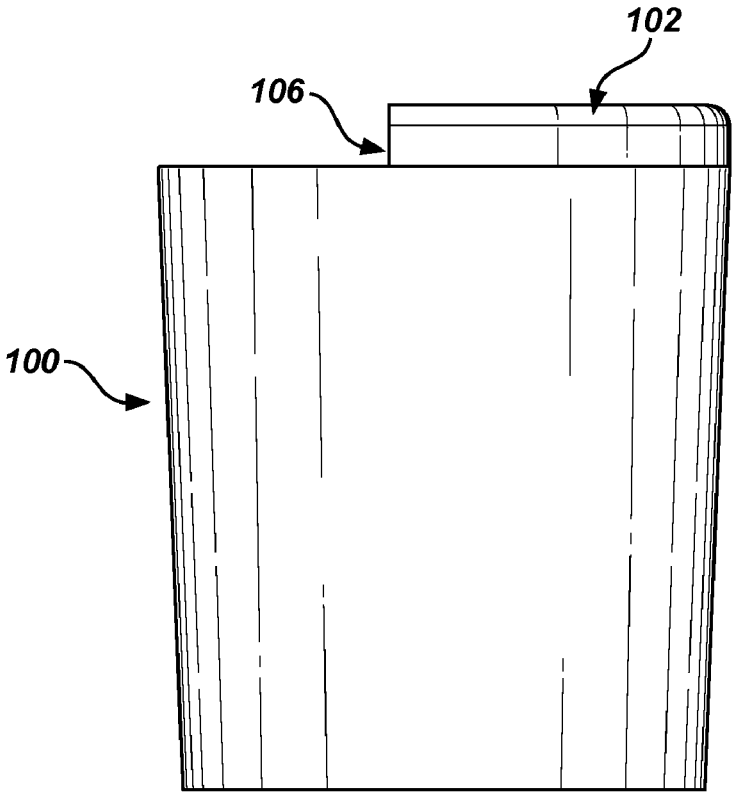
FIG. 4 is a right side view of the ball marker retention system of FIG. 1.
Figure 5:
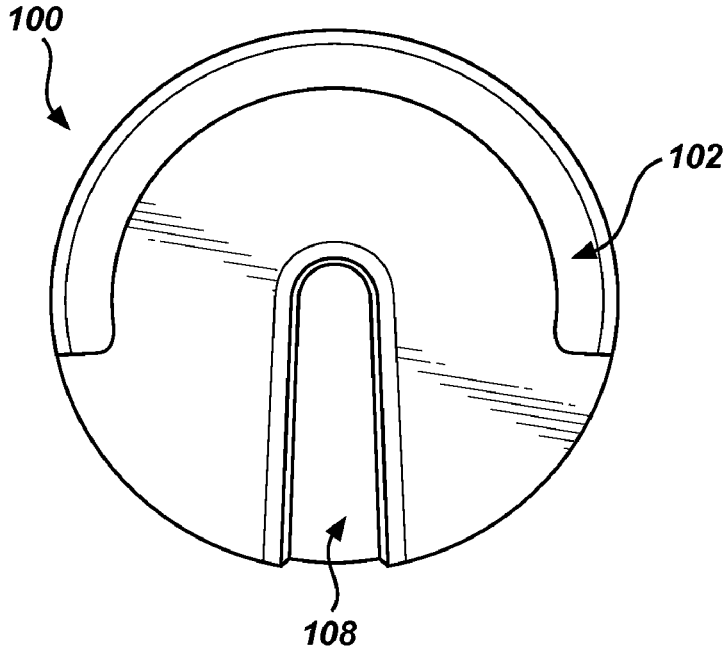
FIG. 5 is a top view of the ball marker retention system of FIG. 1.

The present invention provides three ways of using or incorporating the system with or into a golf club. First, referring to FIG. 7, the retaining cavity 302 may be formed integrally with a grip of a golf club handle 304. This can be done, for example, during manufacture of the golf club 300 to thereby allow the option of golfers purchasing clubs with the feature "built in." In another aspect, referring to reference marker 200 in FIG. 6, the system 204 can be permanently couplable to a golf club handle 206. A golfer could purchase the system provided in this embodiment (along with associated golf ball markers 202) and attach it to a golf club handle 206 of a selected golf club. The golfer could attach or couple the system to the golf club through a variety of means such as, but not limited to, adhesive or screws that could provided with the system when purchased. In another example, referring to FIGS. 3 and 6, the system includes a retaining cavity 104 or 204 is removably attached to a golf club handle 206. In other words, the retaining cavity 104 or 204 formed within an upper portion of a cap 100. The cap 100 can include a cavity 110 configured to receive an end of a golf club handle 206. In this manner, a golfer can selectively attach and remove the system 204 from the golfer's club(s). It is contemplated that one manner of facilitating this removable attachment is to have a cavity 110 that fits over the end of the grip of the golf club and is shaped such that there is sufficient friction to hold the system firmly in place on the club without the use of adhesives, screws, nails, etc.

In another embodiment, referring to FIGS. 1-5, the present invention provides a golf ball marker retention system 100, comprising a storage cavity 104 associated with a golf club and defined by walls, a floor, and a ceiling 102, wherein the volume of the cavity 104 is changed as an object is inserted into the cavity 104. The cavity 104 can be substantially perpendicular to an elongate axis of the golf club handle; and a golf ball marker 120 receivable within the cavity 104. The marker 120 can be insertable and storable within the retaining cavity 104, and can be configured to fit within the storage cavity 104 such that when inserted into the cavity 104 the volume of the cavity 104 is changed in response to this insertion. The ceiling 102 does not have to completely cover the golf ball marker; indeed, advantages are found in not covering it completely, such as allowing a golfer to press their finger on the top of the marker 120 and slide it out of the cavity 104, or to allow a golfer to remove the marker 120 upward through the ceiling. A further improvement to the invention is to include in the floor of the storage cavity, another cavity 108 configured to receive a spike 122 on a golf ball marker 120. This cavity 108 would extend horizontally from the edge of the system 100 in to a depth slightly greater than the radius of the system 100, and would extend vertically from the floor of the storage cavity 104 downward a sufficient distance to allow for spikes 122 of various lengths. This embodiment further includes the options discussed above relating to the attachment or use of the device in combination with a golf club.

The present invention further provides a method for retaining a golf ball marker, comprising the steps of: providing a golf club; providing a retaining cavity associated with a handle of the golf club and having an entry channel that expands as an object is inserted and contracts when the object has been fully inserted, and wherein the cavity is substantially perpendicular to an elongate axis of the golf club handle; providing a golf ball marker; and forcibly removably inserting the golf ball marker into the retaining cavity, elastically deforming the entry channel during insertion.

This method further includes steps for combining the retaining cavity with the golf club. One such step is where the retaining cavity is formed integrally with a grip portion of the golf club handle. Another such step is to coupling the retaining cavity to the golf club handle in an instance where the retaining cavity is not formed integrally with the golf club handle. The third step provided is to removably attach the retaining cavity to the golf club handle.

It is contemplated that the following description, along with reference to FIGS. 1-5, provides details and specification for creating the best mode of the current invention. Since many golfers have multiple putters, rather than requiring them to purchase new putters with the current invention formed integrally with the putter or to acquire multiple golf ball marker retention systems 100, it is useful to provide the system 100 in a removably attachable manner. In this way a golfer can purchase one such system 100 and use it on a number of different clubs.

The system 100 can be formed from a flexible rubber material. The system 100 can be designed such that the radius of the system 100 when viewed from above is about 0.569 inches. Again viewed from above, the radius from the inner edge of a retaining wing 102 to the center of the system can be a bout 0.445 inches. Regarding the cavity 108, for a spike 122 on the ball marker 120, the width of the cavity 108 at the edge of the system 100 can be about 0.185 inches at the bottom and about 0.207 inches at the top. The walls of this cavity 108 slope inwardly towards each other at an angle of approximately 4.0 degrees. Further this cavity 108, when viewed from above (FIG. 5) the innermost wall of the cavity 108 can be defined by a curvature having a radius of about 0.073 inches. The center of this curvature can be the center of the entire system 100. The retaining wings 102 can extend a full semi-circle plus an additional 0.115 inches on each side around the system 100 exactly on the opposite side that has the opening on the edge for the ball marker spike 122.

When viewed from the side (FIGS. 3-4), the height of the system 100 can be about 1.340 inches from top to bottom. The depth of the cavity 104 for the marker 120 can be about 0.060 inches, and the depth of the retaining wings 102 above said cavity 104 can likewise be about 0.060 inches. The depth of the cavity 108 for the marker spike 122 can be about 0.330 inches as measured from the base of the marker cavity 104 to the base of the spike cavity 108, or about 0.450 inches as measured from the top of the system 100 to the base of the spike cavity 108. The thickness of material between the spike cavity 108 and the cavity 110 for receiving a golf club handle can be about 0.080 inches. The height of the system 100 from the base of the marker cavity 104 (or the top of the spike cavity 108) to the base of the system 100 can be about 1.220 inches. This cavity 110 for receiving the golf club handle, the "cap cavity" 110 is defined by walls that slope inwardly towards each other from the bottom of the system 100 towards the top. If the marker cavity 104 is considered to be horizontal or vertically about 0.0 degrees, the walls of the cap cavity 110 can slope inwardly at about 91.0° with respect to the marker cavity 104. The outer edges of the system 104 taper inwardly from top to bottom such that the radius of the system 100 at the bottom is about 0.518 inches.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

The invention claimed is:

1. A golf ball marker retention system, comprising:

a retaining cavity associated with a golf club handle, the retaining cavity having:

an entry channel that expands as an object is inserted and contracts when the object has been substantially fully inserted within the cavity, the cavity being oriented substantially perpendicular to an elongate axis of the golf club handle; and a floor surface; and a ball marker receivable within the cavity, the ball marker being insertable and storable within the retaining cavity and being sized and shaped such that, as the marker is inserted into the cavity through the entry channel, the entry channel first expands and then contracts after the marker has been substantially fully received within the retaining cavity; wherein the floor surface of the retaining cavity supports a majority portion of an underside of the ball marker when the ball marker is received within the cavity.

2. The golf ball marker retention system of claim 1, wherein the system includes a slidable track, wherein the marker can be inserted into the cavity by sliding the marker through or within the slidable track.

3. The golf ball marker retention system of claim 1, wherein the system includes at least one retaining wing that at least partially defines the cavity and that aids in or contributes to retaining the ball marker within the retaining cavity.

4. The golf ball marker retention system of claim 3, wherein the at least one wing is formed of a resilient material such that the retaining wing is sufficiently rigid to retain the marker within the cavity, and is sufficiently flexible to facilitate removal of the ball marker from the cavity in a direction other than that in which the cavity is oriented.

5. The golf ball marker retention system of claim 3, wherein an upper portion of the ball marker is at least partially covered by the retaining wing when the ball marker is inserted within the retaining cavity, such that the ball marker is restricted from moving in an upward direction out of the retaining cavity.

6. The golf ball marker retention system of claim 3, wherein the ball marker can be forcibly removed from the retaining cavity past or through the retaining wing that at least partially covers the upper portion of the ball marker.

7. The golf ball marker retention system of claim 1, wherein the retaining cavity is formed integrally with a grip of a golf club handle.

8. The golf ball marker retention system of claim 1, wherein the retaining cavity is permanently coupleable to a golf club handle.

9. The golf ball marker retention system of claim 1, where the retaining cavity is removably attached to a golf club handle.

10. The golf ball marker retention system of claim 1, wherein the retaining cavity is formed within an upper portion of a cap, said cap further comprising a cavity configured to receive an end of a golf club handle.

11. A golf ball marker retention system, comprising:

a storage cavity associated with a golf club and defined by walls, a floor, and a ceiling, wherein the volume of the cavity is changed as an object is inserted into the cavity, and wherein the cavity is oriented substantially perpendicular to an elongate axis of the golf club handle; and a golf ball marker receivable within the cavity, the marker being insertable and storable within the retaining cavity, and configured to fit within the storage cavity and configured in a manner that when inserted into the cavity the volume of the cavity is changed in response to the insertion; wherein the floor of the storage cavity supports a majority portion of an underside of the golf ball marker when the golf ball marker is received within the cavity.

12. The golf ball marker retention system of claim 11, wherein the ceiling does not completely cover the golf ball marker.

13. The golf ball marker retention system of claim 11, wherein the floor of the storage cavity further comprises a cavity configured to receive a spike on a golf ball marker.

14. The golf ball marker retention system of claim 11, wherein the retaining cavity is removably attached to the golf club handle.

15. The golf ball marker retention system of claim 11, wherein the retaining cavity can be permanently attached to the golf club handle.

16. The golf ball marker retention system of claim 11, wherein the retaining cavity is formed integrally with a grip portion of the golf club handle.

17. A method for retaining a golf ball marker, comprising:

obtaining a golf club, the golf club having a retaining cavity associated with a handle thereof, the retaining cavity having an entry channel that expands as an object is inserted and contracts when the object has been fully inserted therein, the cavity being substantially perpendicular to an elongate axis of the golf club handle and including a floor surface;

obtaining a golf ball marker; and forcibly and removably inserting the golf ball marker into the retaining cavity by elastically deforming the entry channel with the golf ball marker while inserting it into the retaining cavity and positioning an underside of the golf ball marker upon the floor surface of the retaining cavity such that the floor surface supports a majority portion of the golf ball marker.

18. The method of claim 17, wherein the retaining cavity is formed integrally with a grip portion of the golf club handle.

19. The method of claim 17, wherein the retaining cavity is coupled to the golf club handle.

20. The method of claim 17, wherein the retaining cavity is removably attached to the golf club handle.

* * * * *